United States Patent [19]

Yasugahira et al.

[11] 4,146,352

[45] Mar. 27, 1979

[54] DIAPHRAGMS FOR AXIAL FLOW FLUID MACHINES

[75] Inventors: Norio Yasugahira; Takeshi Sato; Kuniyoshi Tsubouchi, all of Hitachi, Japan

[73] Assignee: Hitachi, Ltd., Japan

[21] Appl. No.: 734,528

[22] Filed: Oct. 21, 1976

[30] Foreign Application Priority Data

Oct. 31, 1975 [JP] Japan ..... 50-130412

[51] Int. Cl.[2] ..... F01B 35/00; F01D 13/02

[52] U.S. Cl. ..... 415/144; 415/DIG. 1

[58] Field of Search ..... 415/DIG. 1, 119, 144

[56] References Cited

FOREIGN PATENT DOCUMENTS

| | | | |
|---|---|---|---|
| 390486 | 2/1924 | Fed. Rep. of Germany | 415/DIG. 1 |
| 360205 | 6/1938 | Italy | 415/DIG. 1 |
| 504214 | 4/1939 | United Kingdom | 415/DIG. 1 |

*Primary Examiner*—Carlton R. Croyle

*Assistant Examiner*—R. E. Gluck

*Attorney, Agent, or Firm*—Craig & Antonelli

[57] ABSTRACT

A diaphragm for an axial flow fluid machine comprising inner and outer walls for defining an annular fluid flow passage therebetween, a blade lattice having a plurality of stationary blades disposed in the fluid flow passage, each of the blades having a concave side surface and a convex side surface, adjacent two stationary blades defining an inter-blade fluid flow path together with the inner and outer walls, a suction port open to a first portion of the fluid flow path adjacent to the concave side surface and the inner or outer wall to suck the fluid therefrom, a blowoff port open to blow off the fluid to a second portion of the fluid flow path adjacent to the inner or outer wall and at which the pressure is lower than that at the first portion, and a passageway for communicating between the suction port and the blowoff port, thereby reducing the secondary flow loss and the blade configuration loss in the blade lattice.

23 Claims, 25 Drawing Figures

DIAPHRAGMS FOR AXIAL FLOW FLUID MACHINES

BACKGROUND OF THE INVENTION

1. Field of the Invention

This invention relates to an axial flow fluid machine and more particularly to an internal construction or diaphragm of a stage in a steam turbine, gas turbine, compressor and so on.

2. Description of the Prior Art

Stationary blades and rotary blades used in ordinary axial flow fluid machines, particularly in high and intermediate stages of steam turbines and in gas turbine stages, have a small aspect ratio (blade chord/blade height). In axial flow turbines, there are various kinds of losses, such as a blade profile loss, a secondary flow loss and a tip clearance leakage loss. In the turbine stages provided with the blades having a small aspect ratio, the secondary flow loss is greatly increased in comparison with the other losses. The secondary flow loss is caused by the interference of the flow in the blade lattice with the boundary layers developed on the inner and outer wall surfaces of the diaphragm, and there have, therefore, been proposed some methods for reducing the secondary flow loss, such as (1) a method for controlling the vortex flow, (2) a method for adjusting the blade inclination and (3) a method for converging the inner and outer walls. However, none of these methods is a definitive expedient for reducing the secondary flow loss, because there practical difficulties in the alternation of the blade configuration and the blade assembly and the working of the walls.

SUMMARY OF THE INVENTION

It is an object of the present invention to provide a diaphragm for an axial flow fluid machine, such as a turbine or a compressor, which has a high efficiency by reducing the secondary flow loss caused in the diaphragm and thus enhancing the stage performance.

It is another object of the invention to provide a diaphragm for an axial flow fluid machine in which the cross flow in the diaphragm directed from the concave side of a stationary blade to the convex side thereof is weakened to prevent the occurence of a large circulation flow within the blade lattice.

It is a further object of the invention to achieve the above two objects without making any substantial change in the construction and shape of the stationary blades of the diaphragm for a conventional axial flow fluid machine.

According to the present invention, there is provided a diaphragm for an axial flow fluid machine comprising an inner wall of the diaphragm, an outer wall thereof for defining an annular fluid flow passage between it and said inner wall, a blade lattice having a plurality of stationary blades disposed in said fluid flow passage, each of said blades having a concave side surface and a convex side surface, adjacent stationary blades defining an inter-blade fluid flow path together with said inner and outer walls of said diaphragm, a suction port means open to a first portion of said inter-blade fluid flow path adjacent to said concave side surface and said inner wall to suck the fluid therefrom, a blowoff port means open to blow off the fluid to a second portion of said fluid flow path adjacent to said inner wall and at which the pressure is lower than that at said first portion, and a passageway means for communicating between said suction port means and said blowoff port means.

According to the present invention, there is further provided a diaphragm for an axial flow fluid machine comprising an inner wall of the diaphragm, an outer wall thereof for defining an annular fluid flow passage between it and said inner wall, a blade lattice having a plurality of stationary blades disposed in said fluid flow passage, each of said blades having a concave side surface and a convex side surface, adjacent stationary blades defining an inter-blade fluid flow path together with said inner and outer walls of said diaphragm, a suction port means open to a first portion of said inter-blade fluid flow path adjacent to said concave side surface and said outer wall to suck the fluid therefrom, a blowoff port means open to blow off the fluid to a second portion of said flow path adjacent to said outer wall and at which the pressure is lower than that at said first portion, and a passageway means for communicating between said suction port means and said blowoff port means.

Therefore, a first essential point of the present invention is to provide a diaphragm in which its inner and/or outer wall for fixing stationary blades in a stage of an axial flow fluid machine, such as a turbine or compressor, is provided with a suction port adjacent the concave side surface of the respective stationary blade and with a blowoff port adjacent the convex side surface thereof, thereby enabling the cross flow in the inter-blade fluid flow path from the concave side to the convex side to be minimized. Another essential point lies in that the by-pass fluid flow sucked from the suction port is directed to the blowoff port by way of a passageway formed in a portion of the inner and/or outer wall of the diaphragm to which the blade is fixed. Further essential points are that the fluid flow blown off to the convex side of the stationary blade is directed with an angle with respect to the surface of the diaphragm wall and that there is provided an appropriate guide for preventing the disturbance of the main fluid flow in the inter-blade fluid flow path by the blown-off fluid flow.

DETAILED DESCRIPTION OF THE PREFERRED EMBODIMENTS

Figure 1:
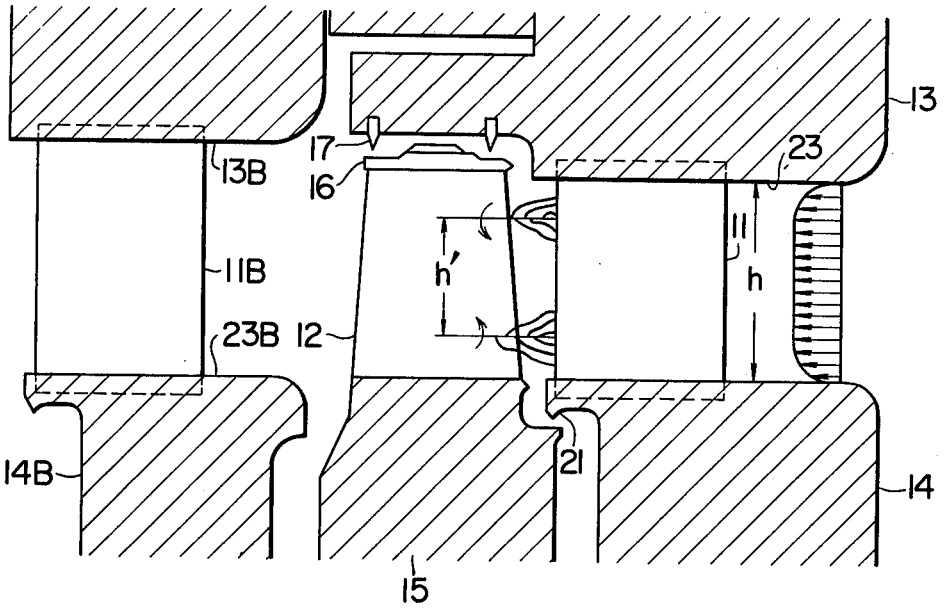
FIG. 1 PRIOR ART
FIG. 1 is a diagrammatic section view of a stage of an axial flow fluid machine and for the purpose of explaining the mechanism of occurence of the secondary flows in a stationary blade lattice.
Figure 2:
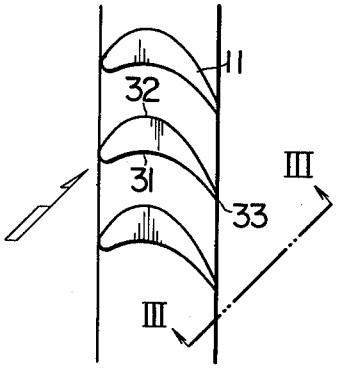
FIG. 2 PRIOR ART
FIG. 2 is a development of part of the stationary blade lattice and for the same purpose as is mentioned in respect of FIG. 1.
Figure 3:
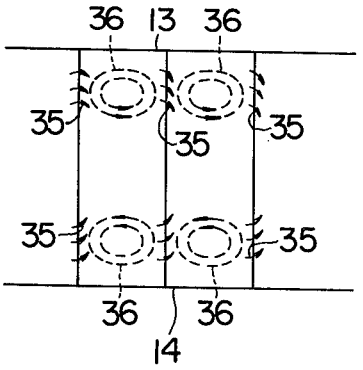
FIG. 3 PRIOR ART
FIG. 3 is a section taken along a line III—III of FIG. 2 and for the same purpose as is mentioned in respect of FIG. 1.
Figure 4:
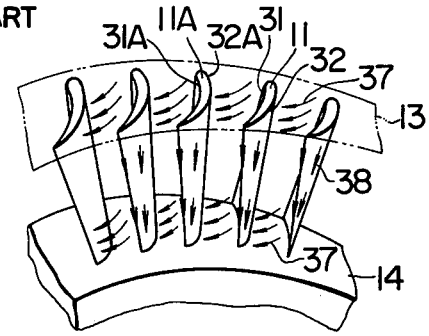
FIG. 4 PRIOR ART
FIG. 4 is a diagrammatic perspective view of part of the stationary blade lattice and for the same purpose as is mentioned in resepct of FIG. 1.
Figure 7A:
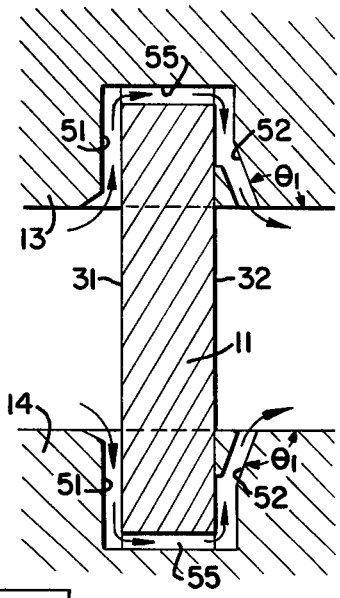
FIGS. 7 and 7*a* are sections taken along a line VII—VII of FIG. 5.

The mechanism of occurence of the secondary flows within an axial flow turbine stage will first be explained in detail by way of FIGS. 1 through 3. FIG. 1 shows an ordinary construction of the axial flow turbine stage which comprises stationary blades 11, rotary blades 12 and outer and inner walls 13 and 14 of the diaphragm. The velocity distribution of the working fluid flowing into the space between adjacent stationary blades has very low speed areas adjacent to the outer and inner walls 13, 14 by the influence of the boundary layers on the walls. With such a velocity distribution, when the fluid flows into the space between the stationary blades, secondary flows are caused by the interference of the fluid flow with the boundary layers so that the effective flow path is reduced to h' from the practical blade height h of the blades 11 thereby causing a great loss in the area of h minus h'. This mechanism of occurence of the secondary flows will next be explained by way of FIGS. 2 through 4. Attention should be given to the fact that as shown in FIG. 1 the moving blades 12 are fixed to a rotary disc 15 and a shroud 16 is fixed to the outer ends of the moving blades and fins 17 are provided on the outer wall 13 of the diaphragm adjacent to the shroud 16 to prevent leakage of the fluid. It should be further noed that a further fin 21 is provided on the downstream end of the inner wall 14 of the diaphragm and stationary blades 11B constituting a subsequent stage are disposed downstream of the blades 12. The subsequent stage has a larger flow path 23B than the flow path 23 of the forward stage, but there is no substantial difference in principle between the stages. Therefore, the similar parts and portions of the subsequent stage to those of the forward stage are referred to by the same reference numerals with the suffixes B. The arrangement described above is well known and no detailed explanation is given herein. The flow within the blade lattice has pressure differences between the concave and convex side portions 31 and 32 of the stationary blades, and the downstream flow from the downstream end of the respective stationary blade generates downstream end vortexes 35 and passage vortexes 36 to form a circulation flow within the diaphragm. Furthermore, these vortexes 35, 36 are interfered with the boundary layers on the outer and inner walls 13, 14 of the diaphragm to generate cross flows 37 and radial flows 38 as shown in FIG. 4 to be grown into large circulation flows. In view of such a mechanism of occurence of the secondary flows within the axial flow turbine stage as is described above, the most convenient method for reducing the loss has to extinguish the cross flow 37 directed from the concave side 31 of the stationary blade 11 to the convex side 32A of the adjacent stationary blade 11A. The construction of the adjacent stationary blade is referred to herein by the reference numerals with the suffixes A.

The present invention will next be explained in detail by way of FIGS. 5 through 24.

Figure 5:
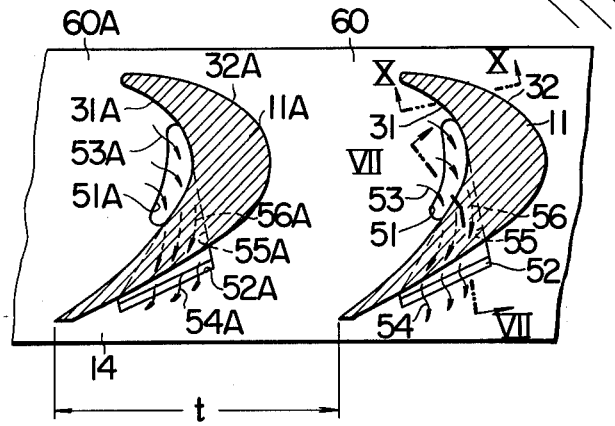
FIG. 5 is a circumferential development in section of a stationary blade lattice of an embodiment of a diaphragm according to the present invention.
Figure 6:
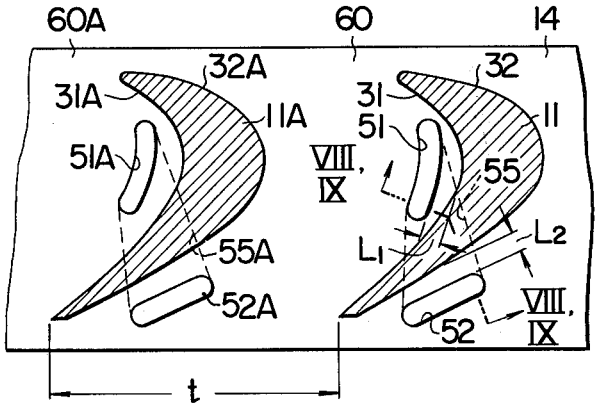
FIG. 6 is a similar view to FIG. 5 and shows a modification of the diaphragm of FIG. 5.
Figure 7:
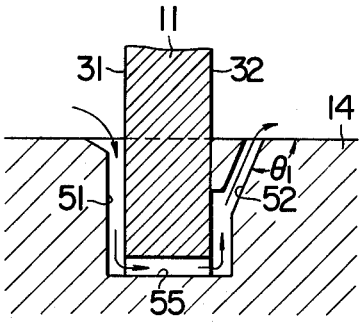
Figure 8:
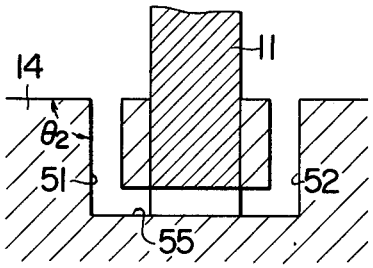
FIGS. 8 and 9 are sections of two variations of the FIG. 6 modification taken along lines VIII—VIII and IX—IX, respectively, of FIG. 6.
Figure 9:
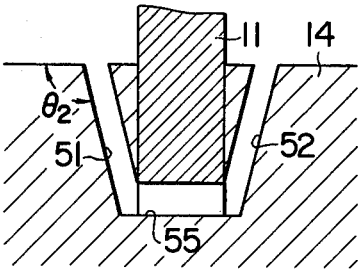
Figure 10:
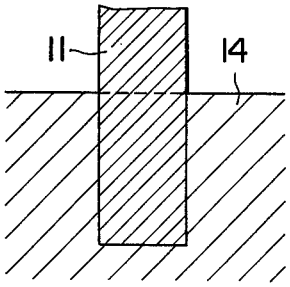
FIG. 10 is a section taken along a line X—X of FIG. 5.

FIG. 5 shows an embodiment of the diaphragm or wall construction for fixing the stationary blades provided in a stage of the axial flow fluid machine to which the present invention is applied. The following will be made in respect of the case that the present invention is applied to the inner wall construction of the diaphragm or wall for fixing the stationary blades, but it should be noted that the present invention may, of course, be applied to the outer wall construction of the diaphragm. The diaphragm for the axial flow fluid machine shown in FIG. 5 comprises a plurality of stationary blades 11, 11A constituting a stationary blade lattice, the opposite ends of each of the stationary blades being inserted into and fixed to the inner wall 14 and the outer wall (not shown), respectively, of the diaphragm. The stationary blades 11, 11A have concave side surfaces 31, 31A and convex side surfaces 32, 32A, respectively, and the concave side surface 31 of the stationary blade 11 and the convex side surface 32A of the adjacent stationary blade 11A together with the inner and outer walls of the diaphragm define an inter-blade flow path 60. The diaphragm is further provided with suction ports 51 open to the surface of the inner wall 14 so that the high pressure flows on the concave sides of the blades 11 are directed into the ports 51, respectively. The fluid flows 53 sucked into the ports 51 are conducted through passageways 55, respectively, formed in the inner fixed portions of the respective blades 11, and hence to blowoff ports 52, respectively, the latter being open to the surface of the inner wall 14 adjacent to the convex side surfaces 32 of the resepctive blades 11. As shown in FIG. 7, each of the blowoff ports 52 is formed to have an angle $\theta_1$ in respect of the surface of the inner wall 14 in a direction apart away from the associated stationary blade, and it is preferable that the angle $\theta_1$ is about 150°. It is unnecessary to form the respective suction and blowoff ports 51, 52 along the whole lengths of the concave and convex side surfaces 31, 32 of the associated blade 11, but it is sufficient to form the ports only along part of the side surfaces of the blade. Therefore, such a portion as is a section X—X shown in FIG. 5 at which there are no suction and blowoff ports, has a quite same construction as the conventional construction as shown in FIG. 10. FIG. 6 shows a modification of the diaphragm of FIG. 5. In this modification, each of the suction ports 51 is spaced by a distance $L_1$ from the concave side surface of the associated blade and each of the blowoff ports 52 is also spaced by a distance $L_2$ from the convex side surface thereof. In both the cases, each of the suction ports 51 is provided to face the flow path 60 at or adjacent the corner defined by the inner wall 14 of the diaphragm and the concave side surface 31 of the associated blade. Each of the blowoff ports 52 is also provided to face an inter-blade flow path adjacent to the inter-blade fluid flow path 60 at or adjacent the corner defined by the inner wall 14 of the diaphragm and the convex side surface 32 of the associated blade. As will be described later, the concave and convex side surfaces of each of the stationary blades may be communicated with each other by means other than the ports 51, 52. A reference character t designates the pitch of the stationary blades. Sufficient effects can be exerted when the ratio $L_1/t$ is within the range of 0 to about 0.3. The communication between the suction and blowoff ports 51, 52 through the passageway 55 shown in FIG. 7 may be altered to that shown in FIG. 8 or 9, and the angle $\theta_2$ taken between the surface portion of the inner wall 14 remote from the blade and the axis of the respective port may be a right angle or an obtuse angle. In any way, the same effect can be brought forth.

Figure 12:
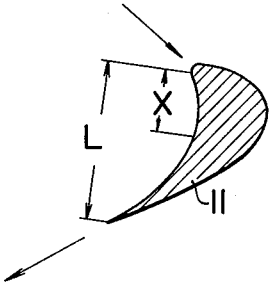
FIG. 12 is a section taken along a line XII—XII of FIG. 11 for the same purpose as that of FIG. 11.
Figure 13:
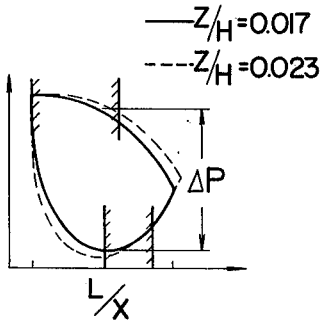
FIG. 13 shows the pressure distribution on the blade shown in FIG. 12.

The principle of the present invention will next be explained in detail by way of FIGS. 11 through 13.

Figure 11:
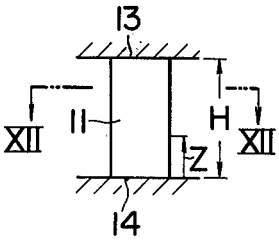
FIG. 11 shows a stationary blade of the blade lattice for the purpose of explaining the principle of the present invention.

In FIG. 11, H designates the effective length of the stationary blade and Z also designates a given height from the inner wall surface of the diaphragm along the length of the blade. In FIG. 12, X designates a given distance from the upstream end of the stationary blade along the concave side surface thereof and L also designates the whole length of the blade. FIG. 13 shows the pressure distribution on the concave and covex side surfaces and the solid curves are the case of Z/H being 0.017 and the dotted curves are the case of Z/H being 0.023. P designates the pressure. In general, the pressure distribution on the blade surfaces of the axial flow fluid machine is such that the pressure on the concave side of the blade is higher than that on the convex side thereof. Therefore, when the suction and blowoff ports 51, 52 are, respectively, formed at portions of the concave and convex sides which are in the hatching areas of X/L, respectively, of FIG. 13, a great pressure difference can be obtained and thus the flow of fluid from the suction port 51 to the blowoff port 52 is caused by the pressure difference $\Delta P$ between the pressures on the concave and convex sides of the root of the blade 11.

Figure 14:
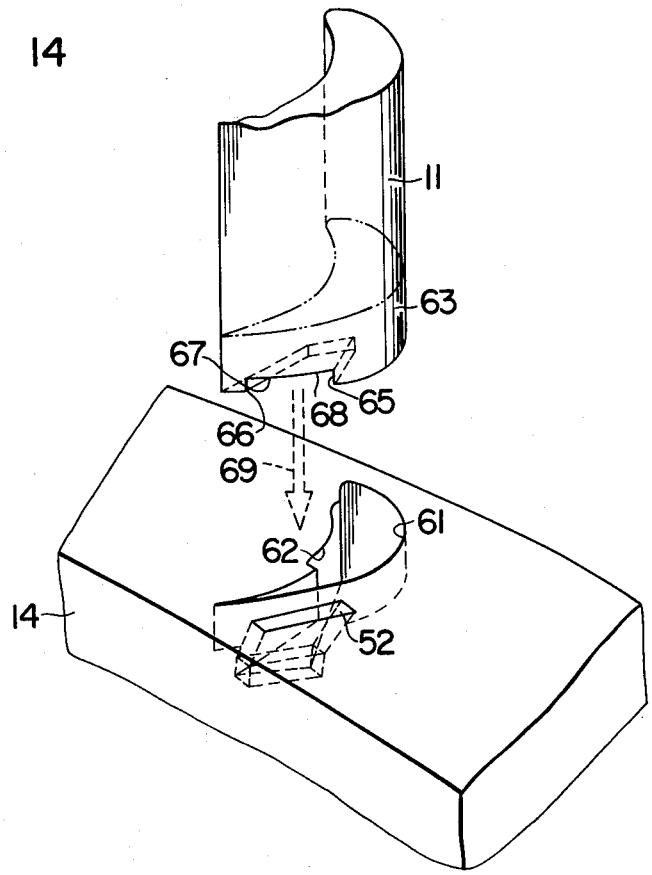
FIG. 14 is an exploded perspective view of part of the diaphragm for the purpose of explaining the construction of the diaphragm.

FIG. 14 is an exploded perspective view of part of the stationary blade and the diaphragm wall construction for fixing it. The diaphragm inner wall 14 for fixing the stationary blades 11 is pre-formed with grooves 61 of which each has a complementary shape for inserting the respective blade thereinto, cut-away portions 62 for forming the respective suction ports, and blowoff ports 52. Each of the stationary blades 11 is also formed in its root end 63 with a groove 68 having walls 65, 66 and 67. When root end 63 has been inserted into the groove 61 in a direction of an arrow 69, the passageway 55 of FIG. 5 is formed by the groove 68 and the bottom wall of the groove 61, and the suction port 51 of FIG. 5 is formed by the cut-away portion 62 and the concave side of the blade, these being communicated with one another and also with the blowoff port 52.

Figure 15:
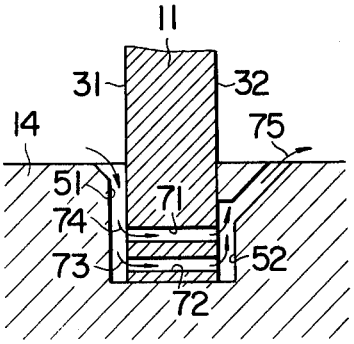
FIG. 15 is a section of a modification of a portion to which the blade is fixed.
Figure 16:
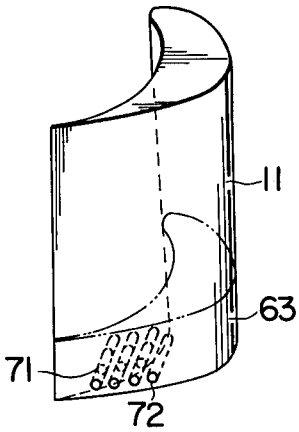
FIG. 16 is a diagrammatic perspective view of the blade of FIG. 15.

The formation of the passageway 55 is not limited to such a groove construction as is described above, and may be achieved by circular by-pass holes 71, 72 which are formed in the lower end portion of the blade to be inserted into the diaphragm inner wall 14 and are communicated with the suction and blowoff ports 51 and 52, as shown in FIGS. 15 and 16. There are caused by-pass fluid flows 73, 74 which are, in turn, blown off from the blowoff port 52.

Figure 17:
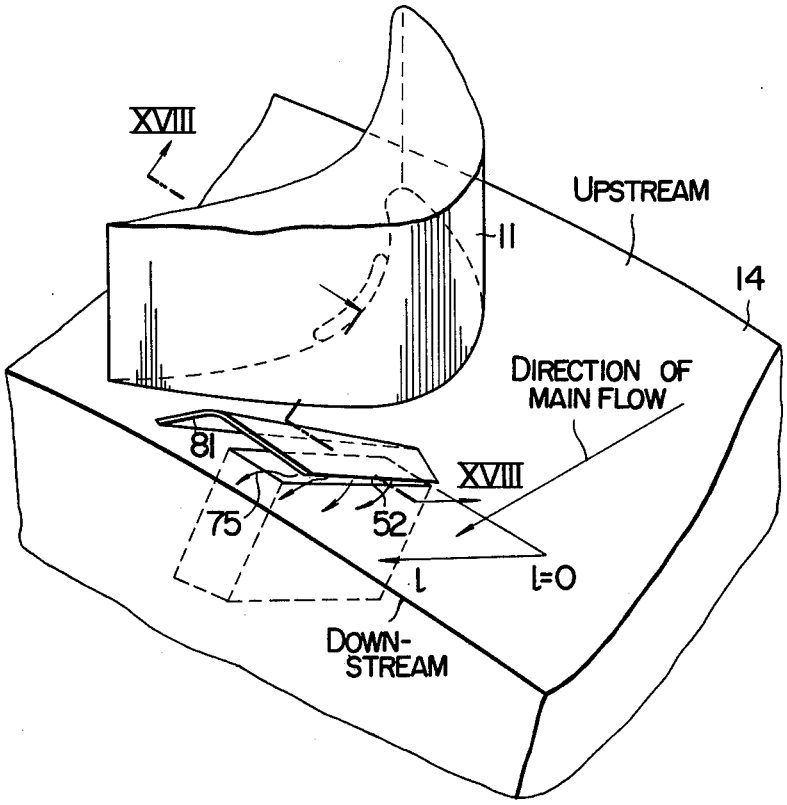
FIG. 17 shows the disposition of a guide cooperating with a blowoff port.
Figure 18:
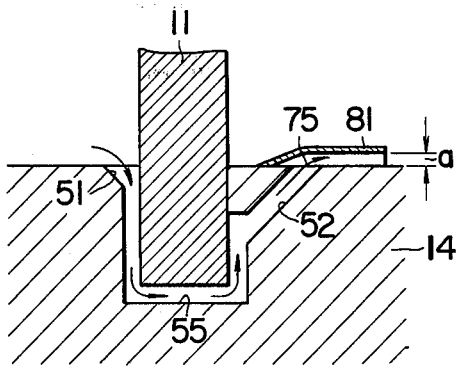
FIG. 18 is a section taken along a line XVIII—XVIII of FIG. 17.

In order to enhance the effect of the present invention, it is desirable to provide a guide plate 81 extending over the blowoff port 52 to deviate the blown-off fluid flow 75 therefrom in the direction of the outlet angle of the main fluid flow in the inter-blade fluid flow path. It is preferable to form the guide plate 81 in such a manner that as shown in FIG. 17 the distance of the guide plate from the surface of the inner wall 14 is zero at the upstream end of the guide plate, that is l is zero, and is gradually increased towards its downstream end at which the distance is an appropriate value a as shown in FIG. 18.

Figure 19:
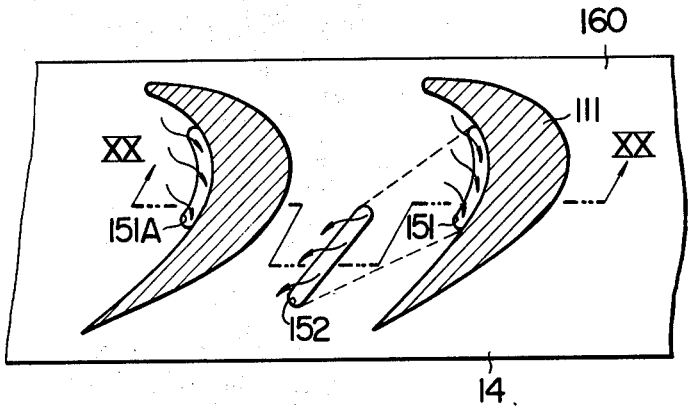
FIG. 19 is a development of part of another embodiment of the present invention.
Figure 20:
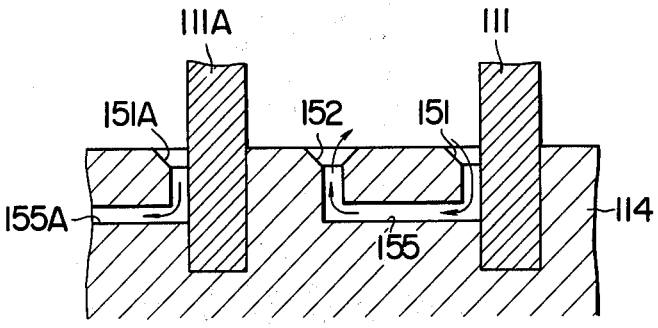
FIG. 20 is a section taken along a line XX—XX of FIG. 19.
Figure 21:
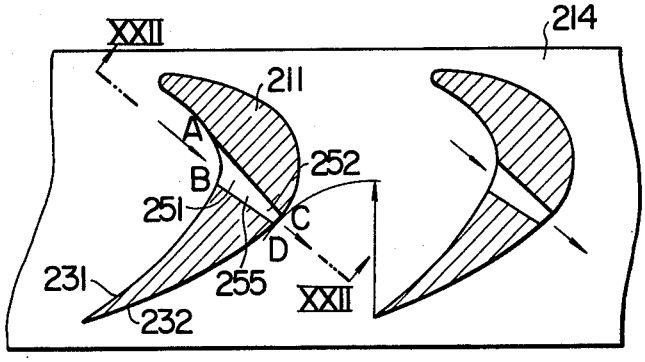
FIG. 21 is a development of part of a still further embodiment of the present invention.
Figure 22:
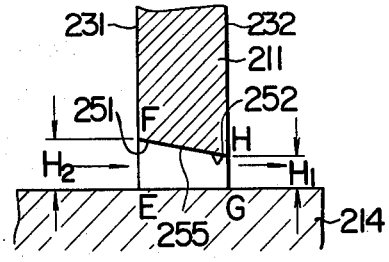
FIG. 22 is a section taken along a line XXII—XXII of FIG. 21.
Figure 23:
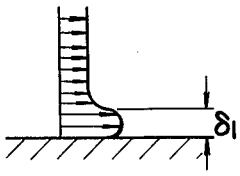
FIG. 23 shows the velocity distribution on a plane vertical in respect of the wall surface of the diaphragm.
Figure 24:
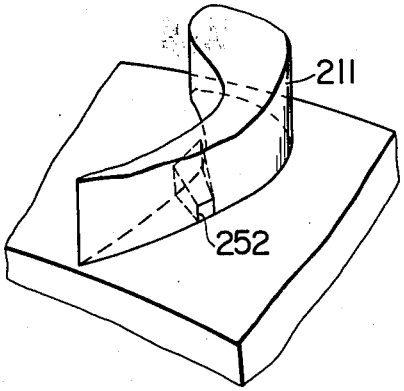
FIG. 24 is a diagrammatic perspective view of the blade of FIG. 21.

FIGS. 19 and 20 show another embodiment of the present invention. This embodiment is similar to the first-mentioned embodiment in that suction ports 151 are provided adjacent to concave sides 132 of stationary blades 111, respectively, on a diaphragm inner wall 114, but differs therefrom in that blowoff ports 152 are provided on intermediate portions of the inter-blade fluid flow paths along the main fluid flows, respectively. The associated suction and blowoff ports 151 and 152 are communicated with each other by respective passageway 155 within the diaphragm inner wall 114 below a fluid flow path 160, thereby permitting the sucked fluid flow to be conducted through the passageway 155 and blown off as shown by arrows. The pressure difference between the suction and blowoff ports 151 and 152 is somewhat lower than that in the first-mentioned embodiment, but the effect can be brought forth that the cross flow from the concave side 131 to the convex side 132, of the respective blade 111 is reduced to decrease the secondary flow loss within the diaphragm.

A further embodiment of the present invention shown in FIGS. 21 through 24 is arranged such that a suction port 251 is formed in a portion $\overline{AB}$ of the lower portion of a concave side 231 of respective stationary blade 211 and a blowoff port 252 is formed in a portion $\overline{CD}$ of its convex side 232 and these ports are straight communicated with each other by a passageway 255 to cause ejection of the fluid thereby directly reducing the secondary flow loss. In this case, the effect of the present invention is greatly exerted, when the suction port $\overline{AB}$ is provided in the high pressure area shown in FIG. 13 and the blowoff port $\overline{CD}$ is also provided at the narrowest point (throat point) of the inter-blade fluid flow path. It is further preferable that the length $\overline{CD}$ of the blowoff port is smaller than the length $\overline{AB}$ of the suction port and the height $\overline{GH}$ ($H_1$) of the blowoff port is also smaller than the height $\overline{EF}$ ($H_2$) of the suction port, thereby accelerating the fluid flow in the passageway 255. In this case, the secondary flow loss is extremely high in the area from the diaphragm inner wall 214 to the height $\delta_1$, and therefore when the height $\overline{GH}$ of the blowoff port is larger than the height $\delta_1$, the effect of the present invention can further be brought forth.

The main effect of the present invention lies in that the secondary flows are greatly lowered in the stationary blade lattices within the diaphragms of various axial flow fluid machines, such as high and intermediate stages of steam turbines, gas turbines and compressors, thereby greatly enhancing their performances, and it is especitally expected to increase the turbine efficiency to 0.3–1.0%, when the invention is applied to a steam turbine for an electric power plant.

Another effect of the present invention lies in that the weight of the stationary blade can be reduced by the provision of the groove or multi-hole construction in its portion fixed to the diaphragm and the weight of the diaphragm can also be decreased by the provision of the suction and blowoff ports and the passageway in the inner and/or outer wall of the diaphragm.

A further effect of the invention is that without changing the profile of conventional stationary blades the secondary flow loss in the stationary blade lattice can be reduced and the diaphragm walls are easily manufactured.

A still further effect of the invention is that by the provision of the suction ports there is caused suction of the boundary layers on the inner and outer portions of the stationary blades thereby reducing the blade configuration loss.

What is claimed is:

1. A diaphragm for an axial flow fluid machine, comprising inner and outer diaphragm walls defining therebetween an annular fluid flow passage, a blade lattice having a plurality of stationary blades disposed in said fluid flow passage, each of said blades having a concave side surface and a convex side surface, adjacent stationary blades defining therebetween an inter-blade fluid flow path together with said inner and outer diaphragm walls, a suction port means in the inner diaphragm wall open to a first portion of said inter-blade fluid flow path adjacent to said concave side surface and said inner diaphragm wall to suck the fluid therefrom, a blowoff port means in the inner diaphragm wall open to blow off the fluid to a second portion of an adjacent inter-blade fluid flow path adjacent to said convex side surface and the inner diaphragm wall and at which the pressure is lower than that at said first portion, and a passageway means for communicating between said suction port means and said blowoff port means, wherein a portion of the main fluid flow flowing through the inter-blade fluid flow path is sucked through said suction port means and is blown off from said blowoff port means into the adjacent inter-blade fluid flow path to suppress a cross flow flowing from the concave side surface of the stationary blade toward the convex side surface of the adjacent stationary blade.

2. A diaphragm as set forth in claim 1 in which said suction port means and said blowoff port means are provided in the respective stationary blade.

3. A diaphragm as set forth in claim 1 in which said suction port means extends along the configuration of said concave side surface.

4. A diaphragm as set forth in claim 1 in which said suction port means is provided apart away from the stationary blade.

5. A diaphragm as set forth in claim 1 in which said suction port means has a sectional area larger than that of said blowoff port means to accelerate the fluid flow.

6. A diaphragm as set forth in claim 1 in which said suction port means and said blowoff port means have wall surfaces extending at substantially right angles with respect to the diaphragm inner wall.

7. A diaphragm as set forth in claim 1 in which said blowoff port means has wall surfaces extending at an obtuse angle with respect to the diaphragm inner wall in a direction apart and away from the stationary blade.

8. A diaphragm as set forth in claim 1 in which said suction port means has wall surfaces extending at an obtuse angle with respect the diaphragm inner wall in a direction approaching the stationary blade.

9. A diaphragm as set forth in claim 1 in which said passageway means includes a first cut-away portion formed in an end surface of the stationary blade, a second cut-away portion formed in a groove provided in the diaphragm wall for receiving the end portion of the blade, and said first and second cut-away portions being communicated with each other.

10. A diaphragm as set forth in claim 1 in which said passageway means includes a by-pass hole formed in the end portion of the stationary blade, a cut-away portion formed in a groove provided in the diaphragm inner wall for receiving the end portion of the blade, and these being communicated with each other.

11. A diaphragm as set forth in claim 1 in which there is further provided a guide means for covering said blowoff port means to guide the fluid flow ejected from said blowoff port means along the main fluid flow in said inter-blade fluid flow path.

12. A diaphragm for an axial flow fluid machine, comprising inner and outer diaphragm walls defining therebetween an annular fluid flow passage, a blade lattice having a plurality of stationary blades disposed in said flow passage, each of said blades having a concave side surface and a convex side surface, adjacent stationary blades defining therebetween an inter-blade fluid flow path together with said inner and outer diaphragm walls, a suction port means in said outer diaphragm wall open to a first portion of said inter-blade fluid flow path adjacent to said concave side surface and said outer diaphragm wall to suck the fluid therefrom, a blowoff port means in said outer diaphragm wall open to blow off the fluid to a second portion of an adjacent inter-blade fluid flow path adjacent to said convex side surface and the outer diaphragm wall and at which the pressure is lower than that at said first portion, and a passageway means for communicating between said suction port means and said blowoff port means, wherein a portion of the main fluid flow flowing through the inter-blade fluid flow path is sucked through said suction port means and is blown off from said blow-off port into the adjacent inter-blade fluid flow path to suppress a cross flow flowing from the concave side surface of the stationary blade toward the convex side surface of the adjacent stationary blade.

13. A diaphragm as set forth in claim 12 in which said suction port means and said blowoff port means are provided in said stationary blades.

14. A diaphragm as set forth in claim 12 in which said suction port means extends along the configuration of said concave side surface.

15. A diaphragm as set forth in claim 12 in which said suction port means is provided apart away from the stationary blade.

16. A diaphragm as set forth in claim 12 in which said suction port means has a sectional area larger than that of said blowoff port means to accelerate the fluid flow.

17. A diaphragm as set forth in claim 12 in which said suction port means and said blowoff port means have wall surfaces extending at substantially right angles with respect to the diaphragm outer wall.

18. A diaphragm as set forth in claim 12 in which said blowoff port means has wall surfaces extending at an obtuse angle with respect to the diaphragm outer wall in a direction apart and away from the stationary blade.

19. A diaphragm as set forth in claim 12 in which said suction port means has wall surfaces extending at an obtuse angle with respect to the diaphragm outer wall in a direction approaching the stationary blade.

20. A diaphragm as set forth in claim 12 in which said passageway means includes a first cut-away portion formed in an end surface of the stationary blade, a second cut-away portion formed in a groove provided in the diaphragm outer wall for receiving the end portion of the blade, and said first and second cut-away portions being communicated with each other.

21. A diaphragm as set forth in claim 12 in which said passageway means includes a by-pass hole formed in the end portion of the stationary blade, a cut-away portion formed in a groove provided in the diaphragm outer wall for receiving the end portion of the blade, and these being communicated with each other.

22. A diaphragm as set forth in claim 12 in which there is further provided a guide means for covering said blowoff port means to guide the fluid flow blown off from said blowoff port means along the main fluid flow in said inter-balde fluid flow path.

23. A diaphragm for an axial flow fluid machine, comprising inner and outer diaphragm walls defining therebetween an annular fluid flow passage, a blade lattice having a plurality of stationary blades disposed in said flow passage, each of said blades having a concave side surface and a convex side surface, adjacent stationary blades defining therebetween an inter-blade fluid flow path together with said inner and outer diaphragm walls, a first suction port means in the inner diaphragm open to a first portion of said inter-blade fluid flow path adjacent to said concave side surface and said inner diaphragm wall to suck the fluid therefrom, a first blow-off port means in said inner diaphragm open to blow off the fluid to a second portion of an adjacent inter-blade fluid flow path adjacent to said convex side surface and the inner diaphragm wall and at which the pressure is lower than that at said first portion, a first passageway means for communicating between said first suction port means and said first blowoff port means, a second suction port means in said outer diaphragm wall open to a third portion of the inter-blade fluid flow path adjacent to said concave side surface and said outer diaphragm wall to suck the fluid therefrom, a second blow-off port means in said outer diaphragm wall open to blow off the fluid to a fourth portion of the adjacent inter-blade fluid flow path adjacent to said convex side surface and the outer diaphragm wall and at which the pressure is lower than that at said third portion, and a second passageway means for communicating between said second suction port means and said second blowoff port means, wherein portions of the main fluid flow flowing through the inter-blade fluid flow path are respectively sucked through said first and second suction port means and are blown off from said first and second blowoff port means into the adjacent inter-blade fluid flow path to suppress cross flows flowing from the concave side surface of the stationary blade toward the convex side surface of the adjacent stationary blade.

* * * * *